US006578663B2

(12) United States Patent
Schmitt et al.

(10) Patent No.: US 6,578,663 B2
(45) Date of Patent: Jun. 17, 2003

(54) STEP SIGNAL

(75) Inventors: Thomas J. Schmitt, Jefferson County, KY (US); William H. Frank, Jefferson County, KY (US)

(73) Assignee: Green Bull, Inc., Louisville, KY (US)

( * ) Notice: Subject to any disclaimer, the term of this patent is extended or adjusted under 35 U.S.C. 154(b) by 0 days.

(21) Appl. No.: 09/961,645

(22) Filed: Sep. 24, 2001

(65) Prior Publication Data

US 2003/0057019 A1 Mar. 27, 2003

(51) Int. Cl.[7] ..... E06C 5/44
(52) U.S. Cl. ..... 182/18; 182/129
(58) Field of Search ..... 182/18, 129

(56) References Cited

U.S. PATENT DOCUMENTS

| | | | | |
|---|---|---|---|---|
| 700,073 A | * | 5/1902 | Nicholls | |
| 892,281 A | * | 6/1908 | Metter | |
| 1,141,716 A | * | 6/1915 | Kjellstron | |
| 3,298,012 A | * | 1/1967 | Weller | |
| 5,193,129 A | | 3/1993 | Kramer | 385/13 |
| 5,500,635 A | | 3/1996 | Mott | 340/323 |
| 5,971,102 A | | 10/1999 | Brown | 182/129 |

* cited by examiner

*Primary Examiner*—Alvin Chin-Shue
(74) *Attorney, Agent, or Firm*—Polster, Lieder, Woodruff & Lucchesi

(57) ABSTRACT

A structural step including relatively moveable parts wherein pressure step contact therebetween generates an impact audible mechanical sound alarm in a selected decibel range.

8 Claims, 3 Drawing Sheets

STEP SIGNAL

BACKGROUND OF THE INVENTION

The present invention relates to a structural step and more particularly a mechanical sound alarm signal for the bottom step of a ladder.

Pressure sensitive signal devices are known in the ladder art, attention being directed to U.S. Pat. No. 5,193,129, issued to Dennis A. Kramer on Mar. 9, 1993, which teaches a comparatively complex fiber-optic micro bending structure associated with a ladder rung to enhance a pressure sensitive signal and to U.S. Pat. No. 5,971,102, issued to Norma Brown on Oct. 26, 1999, which patent teaches at FIGS. 10 and 11 and Column 9, lines 33–65, another comparatively complex pressure sensitive ladder step, to provide an electrical, battery powered audible alarm.

Finally, attention is directed to U.S. Pat. No. 5,500,635, issued to J. C. Matt on Mar. 19, 1996, which teaches an even more complex impact sensing element such as a shoe, apparel, ball, or fishing lure to generate an electrical signal to a battery powered light or sound emitting unit.

The present invention provides a unique and novel mechanical structure, which is completely independent of the electrically powered signaling systems of past arrangements. The unique and novel arrangement of the present invention produces by mechanical impact or frictionally an audible step warning signal, requiring only long-wearing, comparatively reliable, relatively moveable mechanical parts which do not require the frequent parts replacement of prior art arrangements.

The novel arrangement of the present invention requires a minimum of parts, which can be readily and economically assembled with a comparatively minimum number of steps and in a comparatively minimum of space so as to produce an efficient audible alarm signal. Although the present invention provides a unique arrangement for bottom step ladder structure, it is to be understood that the novel pressure sensitive warning signal can be employed in other step and platform environments.

Various other features of the present invention will become obvious to one skilled in the art upon reading the disclosure set forth herein.

BRIEF SUMMARY OF THE INVENTION

More particularly, the present invention provides a pressure sensitive mechanical sound alarm arrangement for a structural step which includes at least two relatively movable mechanical parts with at least one of the parts being returnably movable relative the other between first and second positions wherein mechanical impact or frictional contact between the parts when so moved generates an impact or friction audible sound alarm upon pressure application.

In addition, the present invention provides an arrangement wherein the impact or friction contact between the relatively moveable parts includes a spring loaded keeper member mounted on one of the relatively moveable parts and an alignable apertured retainer on the other part to removably receive the keeper in a mechanical impact or friction generated sound alarm manner.

Further, the present invention provides a modified arrangement wherein mechanical impact contact between the two relatively moveable parts includes a pivotal striker arm mounted on one of the relatively moveable parts to be cooperative with the other of the parts and an aligned clicker member mounted on the other of the parts to be struck by the pivotal striker arm in a sound alarm generating manner.

It is to be understood that various changes can be made by one skilled in the art in one or more of the several parts herein described without departing from the scope or spirit of the present invention. For example, at least a portion of the mechanical impacting or friction contacting relatively moveable part surfaces could be knurled or so configured to enhance the function of the audible sound alarm.

BRIEF DESCRIPTION OF THE DRAWINGS

Referring to the drawings which disclose one advantageous embodiment of the present invention and a modified embodiment thereof.

DETAILED DESCRIPTION OF THE DRAWINGS

Figure 1:
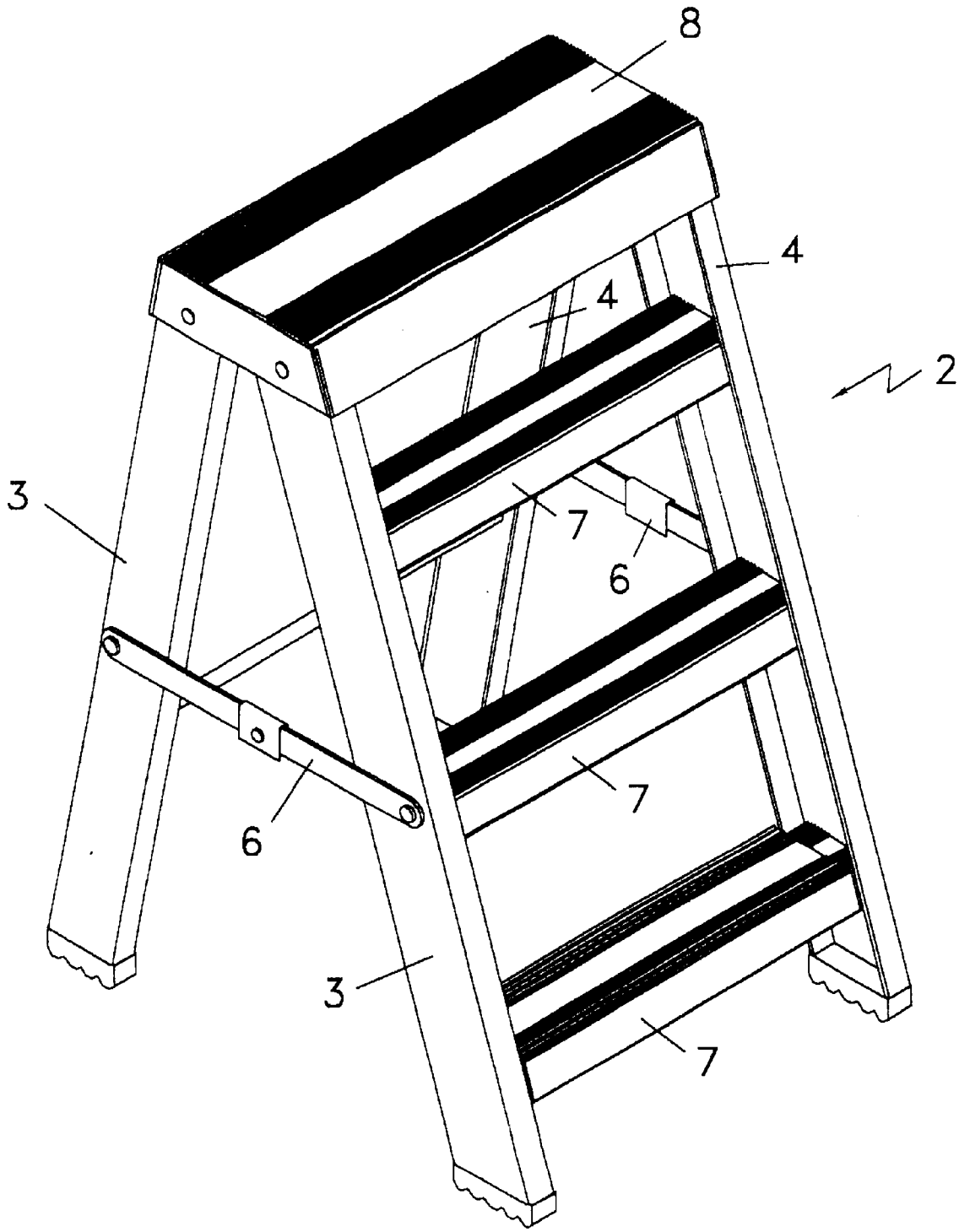
FIG. 1 is a perspective view of a typical step ladder with which the inventive sound alarm signal arrangement can be employed.

Referring to FIG. 1 of the drawings, a step ladder 2 is disclosed including opposed pairs of spaced risers 3 and 4 joined by foldable hinges 6 with spaced ladder support steps 7 and top platform 8. Overall step ladder 2, with the exception of the present invention set forth below, is generally of conventional construction and can be formed from any one of a number of materials such as metal, wood or plastic.

Figure 3:
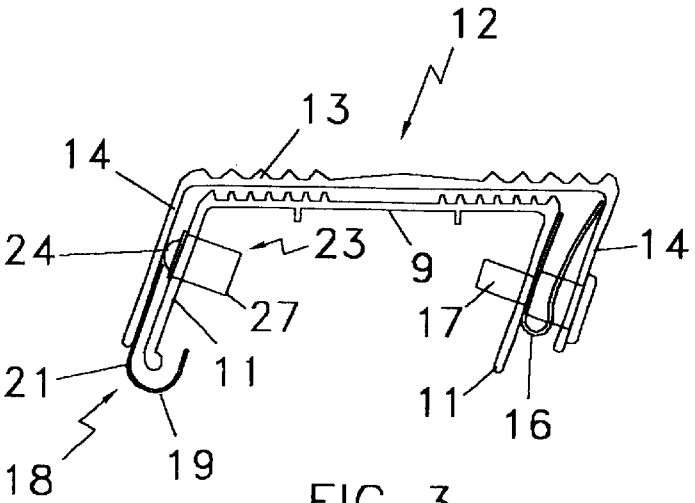
FIG. 3 is a cross-sectional view similar to FIG. 2 with the overlapping pivotal step in a "down" position upon application of step pressure.
Figure 2:
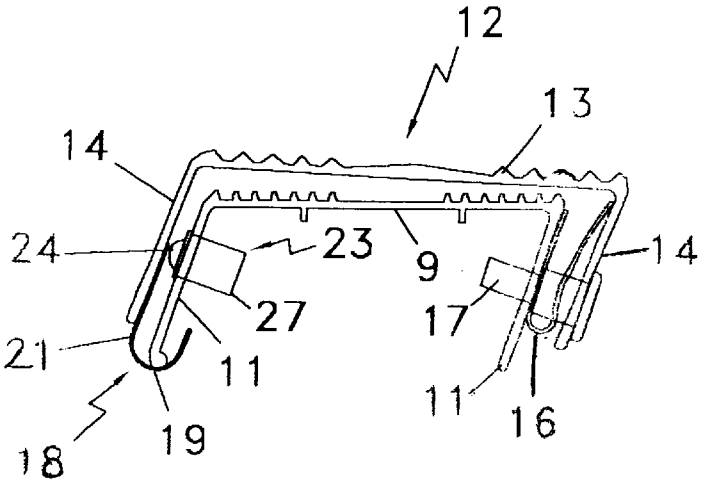
FIG. 2 is a cross-sectional view of the bottom step of a ladder such as shown in FIG. 1 disclosing one form of the inventive apparatus with an overlapping pivotal step in an "up" position prior to step pressure thereon.

Referring to FIGS. 2 and 3 of the drawings, one novel structural embodiment of the present invention is disclosed which advantageously can be employed with the bottom or lowest ladder support step 7.

It is to be understood that the novel invention as described hereinafter is to be considered as not limited to the ladder structure disclosed but can be utilized as an alarm signal for other types of raised platforms known in the construction arts.

As can be seen in FIGS. 2 and 3, lower ladder support step 7 is of approximately U-shaped cross-section to include a longitudinal horizontally extending base portion 9 and two downwardly extending spaced, opposed leg portions 11. Each of the base 9 and leg portions 11 include opposed inner and outer faces. Mounted in spaced relation over support step 7 for pivotal movement thereabout is an overlap step 12 of similar, conforming U-shaped cross-sectional configuration as step 7 so as to include longitudinal, horizontally extending base portion 13 and downwardly extending spaced opposed leg portions 14. A longitudinally extending leaf spring member 16 of a suitably resilient material is folded to have an approximate U-shaped cross-sectional configuration and is positioned between one corresponding pair of the spaced downwardly corresponding legs 11 and 14 of step 7 and overlap step 12, respectively.

At least one pivot pin 17 is arranged to extend between the spaced pair of downwardly extending leg portions 11 and 14 and folded leaf spring 16. Thus, conforming overlap step 12 is pivotally and resiliently moveable relative ladder support 7 which step 12 overlaps. Referring to the opposed downwardly extending overlapping leg portion 11 and 14 a restraining clip member 18 can be seen. Restraining clip member 18 is also folded to provide a U-shaped cross-section to include a base portion 19 and spaced upwardly extending leg portions 21 and 22 with one upwardly extending leg portion 21 being fastened to downwardly extending leg portion 14 of overlap step 12 and the other upwardly extending leg portion 22 surrounding the extremity of corresponding downwardly extending leg portion 11 of step 7 so as to limit relative pivotal movement between ladder support step 7 and overlap step 12.

Figure 3A:
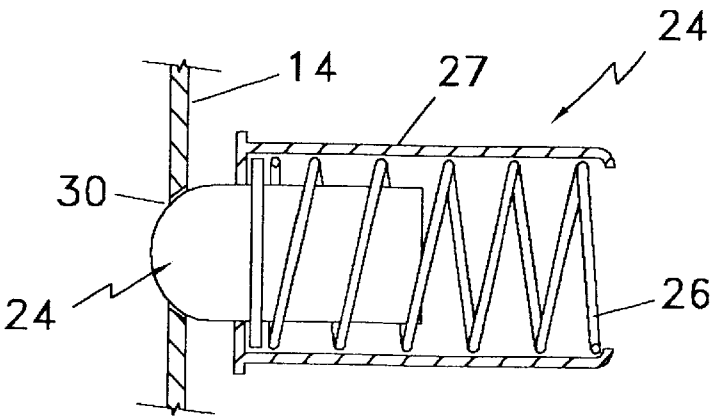
FIG. 3A is a broken away enlarged view of the keeper arrangement of FIGS. 2 and 3.

In accordance with one unique feature of the present invention, a pressure sensitive mechanical impact or frictional sound alarm 23 is provided between the restrained overlapping leg portions 11 and 14 as aforedescribed. This pressure sensitive mechanical impact sound alarm can be designed to provide sounds in the range of approximately seventy (70) to one-hundred-twenty (120) decibels so as to be clearly audible to a user when the bottom overlapped step is resiliently pressure by the climbing and dismounting movement of a user. As can be seen in FIGS. 2, 3 and 3A, alarm 23 includes a spring-loaded keeper catch member 24 with the stem portion thereof surrounded by helical spring 26—all of which is disposed in housing 27. Housing 27 in turn is mounted to downwardly extending leg portion 11 of ladder support 7. In one embodiment of the invention (FIG. 3A), an aligned apertured keeper retainer 30 is disposed in the other corresponding overlapping downwardly extending leg 14 of pivotal overlapping step 12. However, such an aligned keeper aperture 30, as shown in FIG. 3A, can be eliminated as shown in FIGS. 2 and 3. In this regard, it is to be noted in FIGS. 2 and 3 that keeper catch member 24 includes a peripherally rounded head portion, which is sized to yieldably and snuggly engage against upwardly extending leg portion 21 of clip 18 when overlapping step 12 is not actuated. The length of leg portion 21 is selectively measured so that when pressure is applied to overlapping step 12, peripherally rounded head portion of keeper catch member 24 moves in step-off fashion from extended leg portion 21 of clip 18 to engage against the inner face of leg 14 of overlapping step 12 so as to mechanically impact or frictionally create the desirable audible alarm in a completely mechanical manner—such audible alarm being in both embodiments of FIGS. 2, 3 and 3A. It is to be noted that other impacting or frictionally created alarm noise designs can be utilized by one skilled in the ladder art without departing from the scope or spirit of the present invention—including knurled and cross-hatched peripherally engaging frictional surfaces and in this regard, attention is directed to FIGS. 4 and 5 of the drawings which discloses a further modified embodiment of the present invention.

Figure 5:
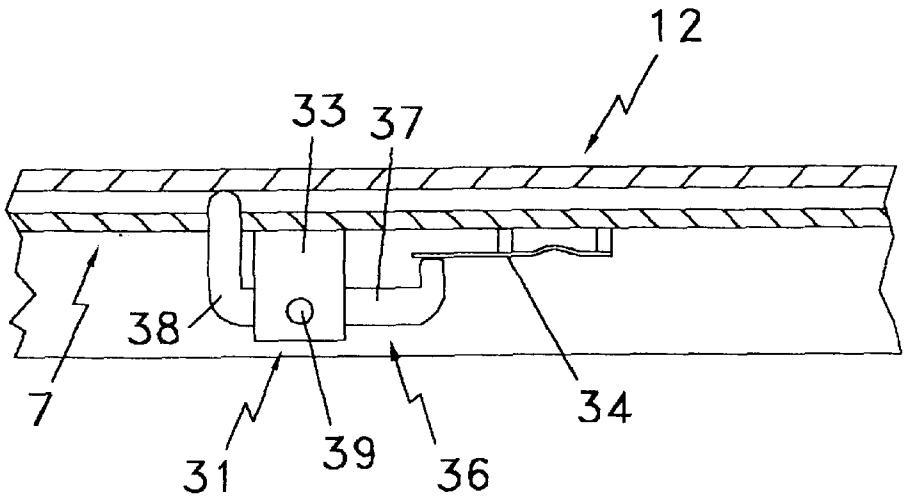
Figure 4:
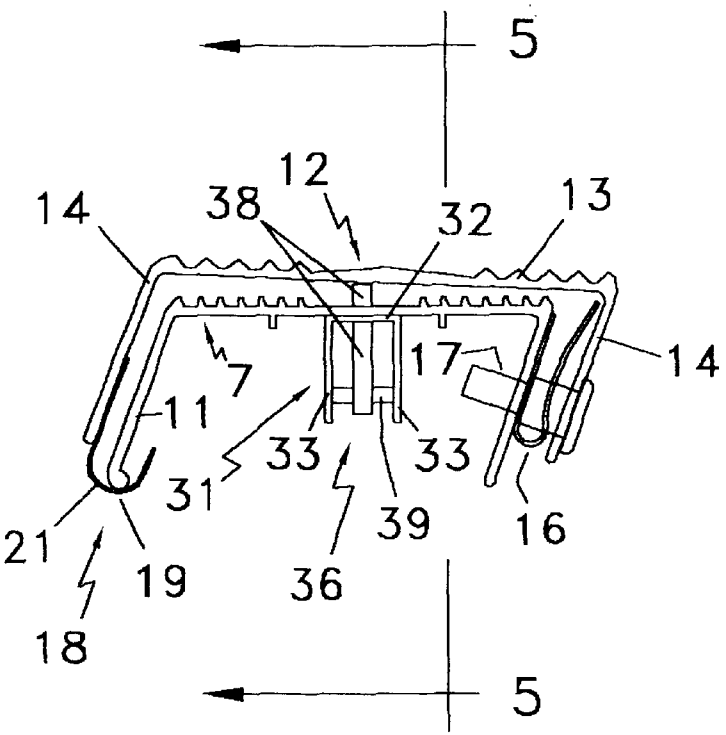
FIG. 4 is a cross-sectional view similar to FIG. 3 disclosing a modified form of the inventive apparatus with the overlapping pivotal step in an "up" position prior to step pressure thereon; and, FIG. 5 is a cross-sectional side portional view in a plane through line 5—5 of FIG. 4 with the overlapping pivotal step in a "down" position upon application of impacting step pressure.

In the embodiment of FIGS. 4 and 5, the overlapping pivotal step arrangement including the leaf spring and restraining members are similar to that aforedescribed and therefore details thereof are not accordingly repeated herein. However, another unique and novel embodiment of a pressure sensitive mechanical sound alarm in a similar decibel range is disclosed in FIGS. 4 and 5. In this embodiment, a U-shaped support bracket 31 having a base 32 and spaced opposed arms 33 downwardly extending from base 32 can be seen. Base 32 is mounted to the bottom surface of bottom structural ladder step 7. A spring leaf clicker member 34 also is mounted on the bottom surface of ladder step 7 in spaced relation to support bracket 31. A longitudinally extending L-shaped striker arm 36 including horizontally extending leg 37 and vertically extending leg 38 has horizontally extending leg 37 pivotally mounted on pin 39 extending between the downwardly extending legs 33 of U-shaped support bracket 31. Vertical leg 38 is arranged to extend through an aperture in bottom step 7 with its upper portion engageable by the lower surface of pivotally mounted overlapping step 12. The cantilevering extremity of horizontally extending leg 37 of L-shaped striker arm 36 is turned in hook-shaped fashion to engage against spring leaf clicker member 34. Accordingly, when step pressure is applied to overlapping pivotal step 12, the L-shaped striker arm 36 pivots about bracket 31 with the cantilevering hook-shaped portion of horizontal leg 37 striking resilient spring-like leaf clicker 34 to an "engage" position to mechanically create an audible impacting clicking sound. When pressure is released on step 12 and vertical arm 38, the mechanism is resiliently urged by spring-like leaf clicker 34 to a "rest" position.

The invention claimed is:

1. In combination with a structural step: a pressure sensitive mechanical and audible sound alarm, said audible sound alarm including said step having at least two relatively moveable mechanical parts, with at least one of said parts comprising a stepping surface overlapping the other of said parts and being returnably moveable relative to the other of said parts between first and second positions wherein mechanical impacting contact between the parts when so moved generates a mechanically created audible sound alarm upon pressure application; said mechanical impacting contact comprising a housing arrangement on one of said relatively moveable parts having connected striker and stem portions moveably mounted thereon with one of said striker and stem portions being cooperative with an alignable apertured retainer on one of said parts to yieldably engage with said alignable apertured retainer; a spring member to spring load said striker and stem portions; and, a stop member serving to limit relative movement of said striker and stem portion.

2. The combination of claim 1, said audible sound alarm being in the range of approximately seventy (70) to one hundred twenty (120) decibels.

3. The combination of claim 1, said structural step being a ladder step and comprising said mechanical parts.

4. The combination of claim 3, said ladder step being the bottom step.

5. The combination of claim 1, said housing arrangement comprising: a longitudinally extending keeper housing; said striker and stem portions being in the form of a keeper for said housing including a slidable keeper catch portion with a peripheral rounded head portion sized to yieldably engage in said alignable apertured retainer; said stem portion extending from said rounded head into said housing; a spring member disposed in said longitudinally extending keeper housing to spring load said keeper stem and catch portions; and, said stop member cooperating with said stem portion to limit relative movement of said keeper catch portion.

6. The combination of claim 1, said housing arrangement comprising a U-shaped support bracket including a base and spaced opposed spaced arms extending from said base of said U-shaped support bracket, said base being mounted to a bottom surface of the other said parts, an aligned clicker member being mounted in cantilever fashion on said bottom surface in spaced relation to said U-shaped support bracket; said striker portion comprising longitudinally extending striker portion pivotally mounted between said spaced opposed arms of said keeper housing U-shaped support bracket with one end of said striker portion being positioned to contact said clicker member and the opposite end comprising said stem portion extending through said alignable aperture disposed in the other of said part to be contacted by said at least one of said parts to move said striker portion end of said pivotal striker portion into striking contact with said cantilevering clicker member in an impacting sound alarm generating manner.

7. In combination with a longitudinally extending fixed bottom step of a ladder, said bottom step being of approximately U-shaped cross-section to include a longitudinal, horizontally extending base portion and two downwardly extending spaced opposed leg portions, each of said base and leg portions including opposed inner and outer faces; a pivotally moveable longitudinally extending overlapping step of similar U-shaped cross-sectional configuration as said bottom step to include longitudinal, horizontally extending base portion and downwardly extending spaced opposed leg portions and sized to spacedly overlap said bottom step to provide two corresponding pairs of spaced opposed downwardly extending legs; a leaf spring member folded to have an approximate U-shaped cross-sectional configuration and positioned between one corresponding pair of said spaced downwardly corresponding legs; a pivot pin extending between said spaced pair of downwardly extending corresponding legs and said folded leaf spring therebetween to spring load said overlapping step to be pivotally moveable between a first and second position; a restraining clip member of U-shaped cross-section to include a base portion and spaced upwardly extending leg portions with one leg portion thereof fastened to the inner face of one of the legs of the other pair of spaced downwardly extending legs of the overlapping step with the base portion and other upwardly extending leg portion thereof surrounding the extremity of the other spaced, downardly extending leg portion of said bottom step to limit relative movement therebetween, said fastened upwardly extending leg portion of said restraining clip member being sized to create a step-off with respect to the downwardly extending leg of the overlapping step to which it is fastened; a pressure sensitive mechanical impact generated sound alarm in the range of approximately seventy (70) to one-hundred-twenty (120) decibels including a spring loaded keeper arrangement mounted on one of said other pair of corresponding spaced downardly extending spaced legs of said spaced base and overlapping steps; a keeper arrangement, said keeper arrangement comprising a keeper housing, a keeper for said housing including a slidable keeper catch portion with a peripheral rounded head portion sized to yieldably engage against said upwardly extending leg of said restraining member fastened to said downward extending leg of said overlapping step; a keeper stem portion extending from said rounded head into said keeper housing; a spring member disposed in said keeper housing to spring load said keeper catch; and, at least one stop member cooperating with said stem portion to limit relative movement of said keeper catch, said rounded head portion engaging against said upwardly extending leg when said overlapping step 16 is in unpressured position to be moved beyond said step-off when said overlapping step is pressured to create said impact generated sound alarm.

8. In combination with a longitudinally extending fixed bottom structural step of a ladder, said bottom step being of approximately U-shaped cross-section to include a longitudinal horizontally extending base portion and two downwardly extending spaced opposed leg portions, each of said base and leg portions including opposed inner and outer faces; a pivotally moveable longitudinally extending overlap step of similar U-shaped cross-sectional configuration as said bottom step to include longitudinally, horizontally extending base portion and downwardly extending spaced opposed leg portions and sized to spacedly overlap said bottom step to provide two corresponding pairs of spaced opposed downwardly extending legs; a leaf spring member folded to have an approximate U-shaped cross-sectional configuration and positioned between one corresponding pair of said spaced downwardly corresponding legs; a pivot pin extending between said spaced pair of downwardly extending corresponding legs and said folded leaf spring therebetween to spring load said overlapping steps to be pivotally moveable between a first and second position; a restraining clip member of U-shaped cross-section to include a base portion and spaced upwardly extending leg portions with one leg portion thereof fastened to one of the legs of the other pair of spaced downwardly extending legs with the base portion and other upwardly extending leg portion surrounding the extremity of the other spaced downwardly extending leg portion to limit relative movement therebetween; a pressure sensitive mechanical sound alarm in the range of seventy (70) to one hundred twenty (120) decibels including: a U-shaped support bracket having a base and spaced opposed arms downwardly extending from said base of said U-shaped support bracket with said base being mounted to said opposed bottom surface of said structural step; a spring leaf clicker member mounted in cantilever fashion on said bottom surface of said step in spaced relation thereto and to said support bracket; a longitudinally extending L-shaped striker arm pivotally mounted between said spaced opposed arms of said U-shaped support bracket with one end positioned to contact said clicker member and the opposite end extending through said structural step above said upper surface to be contacted by said other of said relatively moveable parts to move said other end of said pivotal striker arm into impact striking contact with said cantilevering clicker member in sound alarm generating manner.

* * * * *